US006287240B1

(12) United States Patent
Trabbic

(10) Patent No.: US 6,287,240 B1
(45) Date of Patent: Sep. 11, 2001

(54) VARIABLE RESISTANCE TREADMILL FOR SIMULTANEOUSLY SIMULATING A ROLLING AND SLIDING RESISTANCE, AND A MOVING INERTIA

(76) Inventor: Michael J. Trabbic, 211 Cottage St., Fremont, OH (US) 42420

( * ) Notice: Subject to any disclaimer, the term of this patent is extended or adjusted under 35 U.S.C. 154(b) by 0 days.

(21) Appl. No.: 09/370,921

(22) Filed: Aug. 9, 1999

(51) Int. Cl.[7] ..... A63B 22/00
(52) U.S. Cl. ..... 482/54; 482/51
(58) Field of Search ..... 482/51.54

(56) References Cited

U.S. PATENT DOCUMENTS 5,860,894 * 1/1999 Dalebout et al. ..... 482/54

* cited by examiner

*Primary Examiner*—Glenn E. Richman
(74) *Attorney, Agent, or Firm*—John D. Gugliotta; Michael J. Corrigan

(57) ABSTRACT

The present invention is an exercise treadmill with included weighted plates. The treadmill is essentially a manual treadmill in which the user pushes or pulls on the treadmill to activate it. To operate it, one pushes against a stationary and adjustable hand rail or platform or pulls on a bar or body harness connected to a cable. The walking surface is a belt track similar to conventional treadmills but wider and longer. In such a manner, the user is provided with a system to transfer force from arms or torso (by pushing or pulling) to the feet, to the belt track, to the spindle and shaft, and thereon to the weights and rollers.

16 Claims, 4 Drawing Sheets

VARIABLE RESISTANCE TREADMILL FOR SIMULTANEOUSLY SIMULATING A ROLLING AND SLIDING RESISTANCE, AND A MOVING INERTIA

RELATED APPLICATIONS

The present invention was first described in Disclosure Document Number 444389 filed on Sep. 18, 1998. There are no previously filed, nor currently any co-pending applications, anywhere in the world.

BACKGROUND OF THE INVENTION

1. Field of the Invention

The present invention relates generally to exercise equipment and, more particularly, to a variable resistance treadmill that simulates the resistance of pushing and pulling large objects such as an automobile or a blocking sled.

2. Description of the Related Art

In the related art, there are many designs for treadmills. Treadmills are a popular way that exercise enthusiasts can enjoy a vigorous cardiovascular workout that one would normally get from jogging or running without having to leave the home or gym. Typically, a continuous loop belt made from high strength rubber is supported between two rotating spindles supported by a frame to provide a surface where an exerciser may walk, jog, or run. Many schemes exist where the resistance of the rotating belt is varied according to the users desire to give an optimum workout. Many treadmills now have modern electronics to control the resistance as well as monitoring performance data on the user such as equivalent distance run, speed, time, and even the heart rate of the user. Some treadmills are even motorized to give the user a constant speed workout. However, this significantly reduces the amount of work required by the user to keep the belt turning.

The present invention provides the constant speed workout of a motorized treadmill by utilizing conventional weight lifting plates or other fixed mass placed on the ends of one of the rotating shafts to act as a flywheel. The user can adjust the mass moment of inertia of the belt by selecting plates or other fixed mass of differing weight. A mechanism is placed around the shafts to control the rolling resistance of the belt. Conventional treadmills also are limited in the type of exercise that may be done on them. The present invention also simulates the rolling resistance of objects such as an automobile and pushing/sliding resistance as one would experience in pushing a blocking sled or pulling (sprinting) a sliding weight such as a tractor tire. This gives an exerciser additional workout options not available on conventional treadmills. The present invention is mostly designed from conventional, off-the-shelf materials lending to low cost and ease of construction.

A search of the prior art did not disclose any patents that read directly on the claims of the instant invention; however, the following references were considered related:

| U.S. Pat. No. | Inventor | Issue Date |
|---|---|---|
| 5,595,556 | Daleabout et al. | January 21, 1997 |
| 5,282,776 | Daleabout et al. | February 1, 1994 |
| 5,527,245 | Daleabout et al. | June 18, 1996 |
| 5,318,491 | Houston | June 7, 1994 |
| 5,000,440 | Lynch | March 19, 1991 |

-continued

| U.S. Pat. No. | Inventor | Issue Date |
|---|---|---|
| 4,687,195 | Potts | August 18, 1987 |
| 4,151,988 | Nabinger | May 1, 1979 |

SUMMARY OF THE INVENTION

It is therefore an object of the present invention to provide an improved treadmill design.

It is a main feature of the present invention to provide such a treadmill that will provide the simulation of both a rolling resistance and a moving mass inertia, simultaneously.

It is another feature of the present invention to provide an improved workout for overall body and leg strength.

It is another feature of the present invention to provide an improved workout for increased cardiovascular endurance.

It is yet another feature of the present invention to be easy to use and require no specialized training.

It is still yet another feature of the present invention to simulate the pushing and pulling of a varied rolling resistance.

It is another feature of the present invention to provide for overall body/leg strength and cardiovascular endurance without the present, better, and optimal body posture.

In accordance with a preferred embodiment, a Variable Resistance Treadmill 5 for simultaneously simulating a rolling and sliding resistance, and a moving inertia is provided comprised of a textured tread, frame, two spindles, friction resistance system, push rail, a pull rail, a push board/push surface and conventional Olympic weight training plates or other fixed mass. The Variable Resistance Treadmill 5 will include electronic feedback to monitor the performance of the moving tread as well as electronic variation of the friction resistance.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 6 is a top view of a power mill, according to the preferred embodiment of the present invention.

LIST OF REFERENCE NUMBERS

| | | | |
|---|---|---|---|
| 05 | Power Mill | | Block |
| 10a | Rear Spindle | 28 | Friction Resistance System |

-continued

LIST OF REFERENCE NUMBERS

| | | | |
|---|---|---|---|
| 10b | Front Spindle | | Brake Shoes |
| 11R | Frame Rail | 29 | Friction Resistance System Hydraulic Plunger |
| 11L | Frame Rail | | |
| 12a | Floor Cross Beam | 30 | Friction Resistance System Brake Shoe Pads |
| 12b | Floor Cross Beam | | |
| 12c | Floor Cross Beam | 31L | Shaft Bearing |
| 13 | Floor Cross Beam End Plates | 31R | Shaft Bearing |
| | | 32 | Friction Resistance System and Shaft Bearing Assembly Bolts |
| 14 | Frame Rail and Floor Cross Beams Machine Screws | | |
| 15 | Floor Plate | 33 | Friction Resistance System Control System |
| 16 | Plastic Floor Plate | | |
| 20 | Leveling Feet | 41 | Push and Pull Rail Quick Release Mounting Pins |
| 21 | Tread Belt | | |
| 22R | Take-up End Plate | 42 | Pull Rail Anchors |
| 22L | Take-up End Plate | 43 | Pull Rail |
| 23 | Take-up Bearing Tracks | 44 | Push Rail |
| 24R | Take-up Bearing | 45 | Mounting Brackets |
| 24L | Take-up Bearing | 46 | Push Board/Mounting Bracket Modified Quick Release Pins |
| 25R | Take-up Adjusting Rod | | |
| 25L | Take-up Adjusting Rod | 47 | Push Board |
| 26 | Take-up Bearing Track Machine Screws | 48 | Computer Module |
| | | 49 | Conventional Weight Lifting Plates |
| 27R | Friction Resistance System Block | 50 | Mounting Bracket |
| 27L | Friction Resistance System | | |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
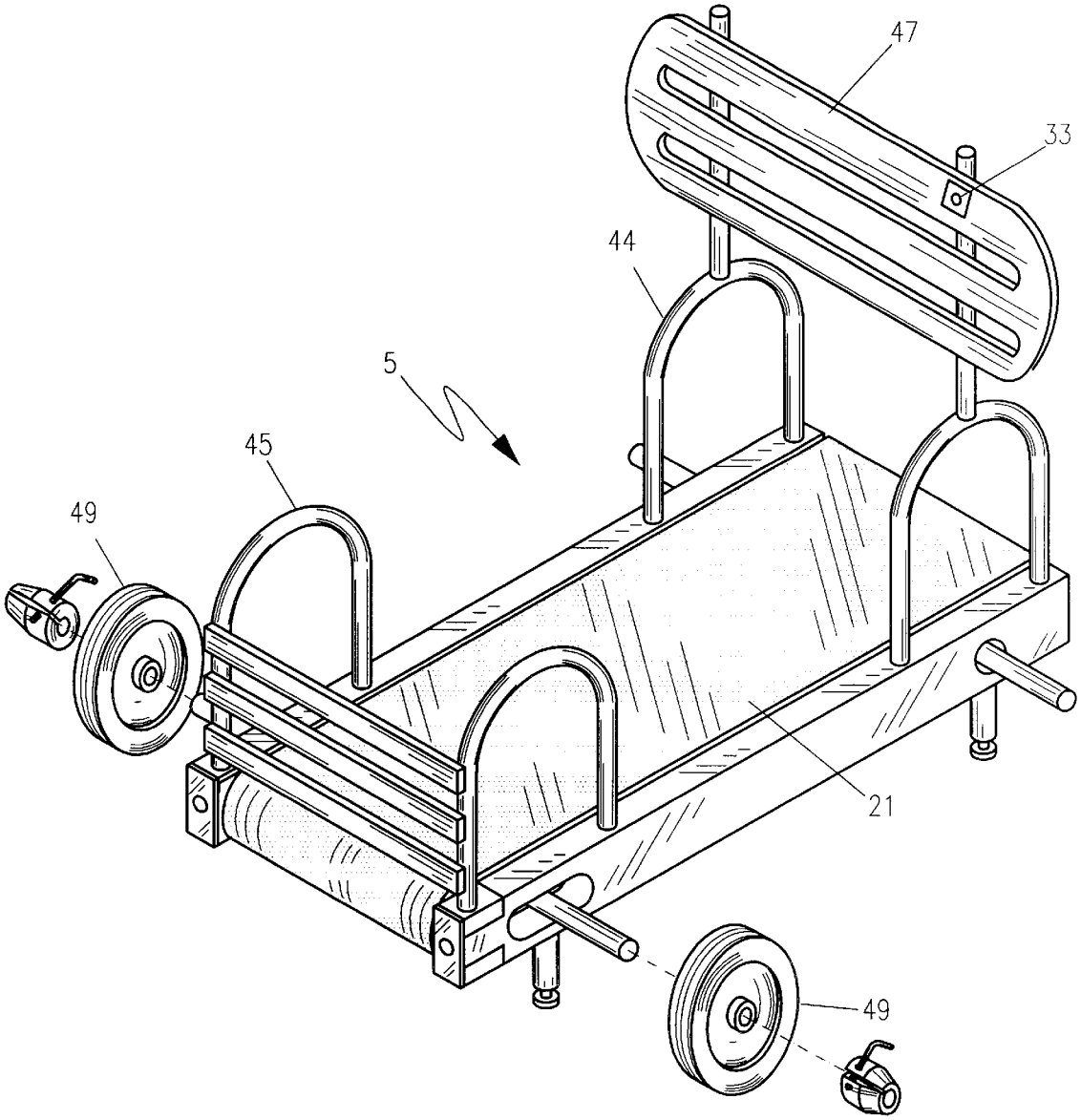
FIG. 1 is a perspective view of a power mill, according to the preferred embodiment of the present invention.
Figure 2:
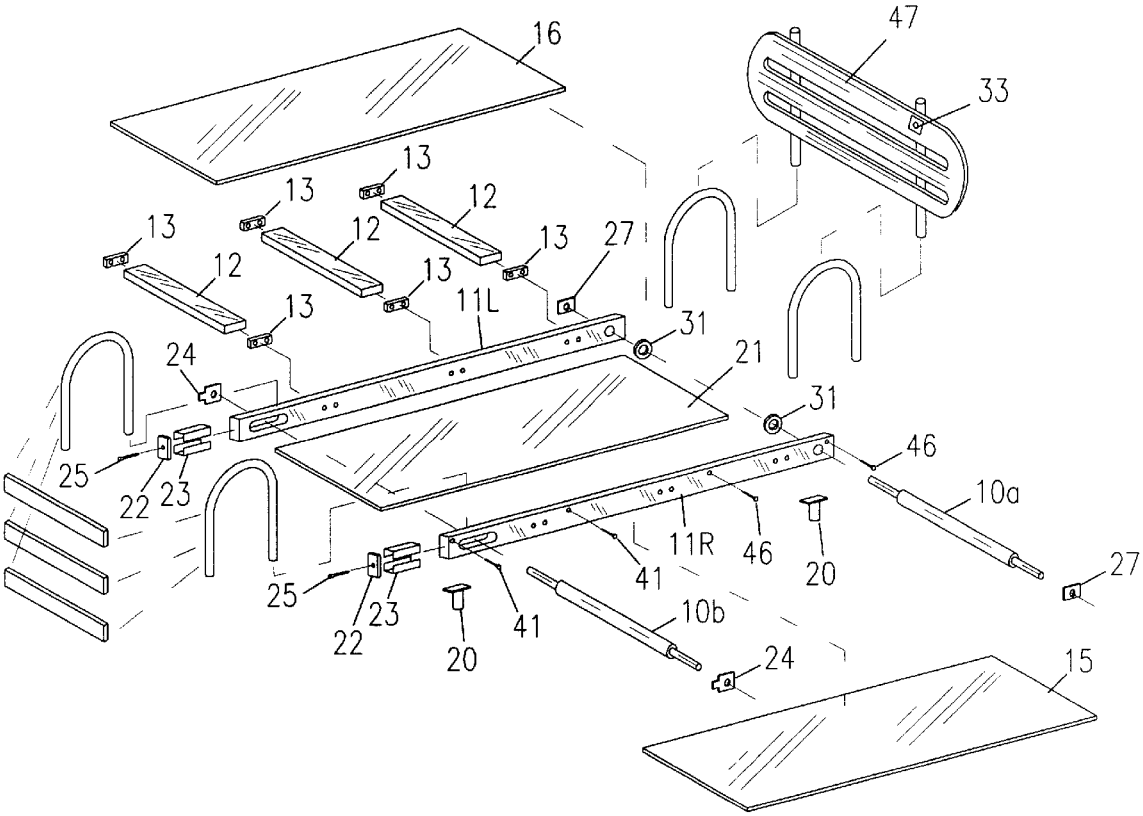
FIG. 2 is an exploded perspective view of a power mill, according to the preferred embodiment of the present invention.

Referring now to FIGS. 1 and 2, a perspective view and an exploded perspective view of a Power Mill 5 is shown, according to the preferred embodiment of the present invention, comprised of a continuous loop tread, a steel frame, two spindles, a means to create and control friction applied to said spindles when rotating, a user push rail and pushboard, a user pull rail, and conventional Olympic weight plates of varying weight.

Tread Belt 21 is of continuous loop construction being made from high strength flexible rubber-fiber matting. Tread Belt 21 has a textured outer surface for providing a surface for mating with the feet of the user, an inner surface for non-slip mating with Spindles 10*a* and 10*b*, and is rotatably suspended there between said Spindles 10*a* and 10*b*.

Frame Rails 11R and 11L are constructed from conventional steel rectangular shaped channel each having a front end, a rear end, and an elongated longitudinal axis. Frame rails 11R and 11L are cut to desired length from conventional length steel rectangular shaped channel. Floor Cross Beams 12*a* and 12*c* interconnect Frame rails 11R and 11L near each end of said Frame Rail 11R and 11L and one Floor Cross Beam 12*b* interconnects said Frame Rail 11R and 11L near the center. Floor Cross Beams 12*a*, 12*b*, 12*c* are also cut to desired length from conventional length rectangular channel. Each end of Floor Cross Beam 12*a*, 12*b*, and 12*c* receives one Floor Cross Beam End Plate 13 which is permanently welded thereto. Floor Cross Beam End Plates 13 are drilled and tapped for receiving Frame Rail and Floor Cross Beam Machine Screws 14. Floor Cross Beam 12*a*, 12*b* and 12*c* are also drilled and tapped on their upper surfaces for receiving Floor Plate Machine Screws 17 for securing Floor Plate 15 to the upper surface of said Floor Cross Beam 12*a*, 12*b*, and 12*c* and Plastic Floor Plate 16 to the upper surface of said Floor Plate 15.

Providing support and raising the completed frame assembly off of the floor are a plurality of four Frame Legs 18 located one each on each end of said Frame Rails 11R and 11L. Welded to one end of each of said Frame Legs 18 is Frame Leg End Plate 19 for permanently receiving one of a plurality of four Leveling Feet 20. Leveling Feet 20 have a base at one end for resting on the floor surface connected to a threaded shaft that is threaded into a threaded aperture in said Frame Leg End Plate 19. The other end of Frame Leg 19 is permanently welded to the lower surface on one of the ends of Frame Rail 11R and 11L. By wrenching said Leveling Feet 20, the user may adjust the height of the Power Mill 5 off of the floor as desired. In an alternate preferred embodiment, said leveling feet may be replaced by a plurality of locking wheels to give the Variable Resistance Treadmill added mobility.

Spindles 10*a* and 10*b* are cylindrical in shape having two ends, dual outer surfaces located adjacent to each of said ends, a single inner surface located between said dual outer surfaces, and an elongated longitudinal axis. Said Spindles 11*a* and 11*b* are made from high strength steel machined and polished on said dual outer surfaces to a diameter for receiving conventional Olympic size weight training plates or other similarly fixed mass and on said single inner surface to a diameter for receiving and providing a non-slip mating surface for said inner surface of said Tread Belt 21. Spindle 10*b* is rotatably supported on said dual outer surfaces by Take-Up Bearings 24R and 24L slidably fixed inside of the hollow inner cavity of Frame Rails 11R and 11L near their respective rear ends. Spindle 10*a* is rotatably supported on said dual outer surfaces by Spindle Bearing 31*a* and 31*b* permanently affixed on the front ends and inboard outer surface of Frame Rails 11R and 11L by Friction Resistance System and Shaft Bearing Assembly Bolts 32.

The outer surfaces of Spindle 10*b* protrude through the center aperture of said Take-Up Bearing 24R and 24L and continue a length past the outboard edges of said Frame Rails 11R and 11L through an elongated semi-circular aperture specially formed in the rear end of Frame Rails 11R and 11L for receiving conventional Olympic weight plates or other similarly fixed mass as heretofore described. Conventional means (not shown) to affix said weight plates or fixed mass to said spindle are contemplated such as conventional spanner nut type collars to ensure said weights or similarly fixed mass rotate with said spindle. Similarly, the outer surfaces of Spindle 10*a* protrude through the center aperture of said Shaft Bearing 31R and 31L and continue a length past the outboard edges of said Frame Rails 11R and 11L through a circular aperture specially formed in the front end of Frame Rails 11R and 11L for receiving conventional Olympic weight plates or other similarly fixed mass as heretofore described. The inner surfaces of said Spindles 10*a* and 10*b* are made to a length to fit inboard of Frame Rails 11R and 11L with enough room left to allow free rotation of said Spindles 10*a* and 10*b*.

Take-up Bearing Tracks 23R, 23L are constructed of solid steel, with two rails fabricated on each end in a parallel, cantilevered manner from each Take-up end plate 22R, 22L. Each Track 23R and 23L is design to interface with a conventional U-shaped channel within the Take-up Bearing 24R, 24L. Two of said tracks are welded to one side of Take-up end plate 22R and 22L, with the open side of the U-channels facing each other, to form a cavity where Take-up Bearing 24R and 24L may be slidably received. The resulting assembly is then inserted into the hollow cavity in the rear end of Frame Rail 11R and 11L providing a means whereby Spindle 10*b* is positioned by and free to spin within said Take-up Bearing 24R and 24L. Take-up Adjusting Rod 25L and 25R is threaded about its elongated longitudinal axis and received by a threaded aperture formed in Take -Up End Plate 22R and 22L for providing a means whereby the tension in Tread Belt 21 may be adjusted. One end of Take Adjusting Rod 25R and 25L is a conventional hex head for receiving a conventional wrench for turning and the other end has starting threads to be received by a threaded aperture formed in Take-up Bearing 24R and 24L. In this manner, Take-up bearing 24R and 24L is forced to slidably traverse within said Take-Up Bearing Tracks 23 by the user wrenching the hex end of said Take-Up Adjusting Rod 25R and 25L until the proper tension is reached in Tread Belt 21.

Friction Resistance System Block 27R and 27L are received within the front of the side rails 11R, 11L in a multi-step manner. First, each Stationary Bearing 31L, 31R is slid into the cavity within the front of the side rail, and placed partially protruding through the sidewall thereof through an orifice designed to receive the bearing. Next, a Friction Resistance System Block 27L, 27R is slid in behind the Bearing 31L, 31R, thereby being impinged between the Bearing and the opposing rail sidewall. Finally, the resulting assembly is then bolted with the front end of Frame Rail 11R and 11L with the outer surface of Spindle 10*a* passing through an aperture formed in the center of said blocks 27R and 27L and an aperture formed on the sides of said Frame Rail 11R and 11L at the front end.

Friction Resistance system Brake Shoes 28R and 28L are slidably fitted within an inside cavity on the interior of said Friction Resistance Block 27R and 27L with one edge curved and contoured to the outer surface of said Spindle 10*a*. Friction Resistance System Brake Shoe Pad 30 are then fitted and bonded to said contour. A cavity on the opposite side slidably receives another Brake Shoe 28 and Brake Shoe Pad 30R bonded thereto contoured to the radius of Spindle 10*a*. A spring contacting the outer surface of Brake Shoe 28 and biased against the wall of said cavity keeps the inner surface of Brake Shoe 28 and Brake Shoe Pad 30 away from the outer surface of said Spindle 10*a*. The purpose of Brake Shoes 28 and Brake Shoe Pad 30 bonded thereto is to create friction according to the user's desire. The other side of Friction Resistance System Block 27R and 27L is in communication with and urged by a friction control means. It is envisioned that, as with most currently available exercise equipment, various types of mechanisms can be incorporated for providing an urging force to the Friction Resistance System Blocks 27R, 27L. By way of example, and not meant as a limitation, such types can include a direct physical link, pneumatic communication, hydraulic communication, or the like. For purposes of teaching the benefits of the present invention it is felt that the type of friction control means is not important, and for purposes of disclosure can be assumed to be any such means currently available within or modified from the relevant art. As such, it is also envisioned that a data acquisition means, of the type currently known within the art, can also be incorporated therein to provide information feedback to the user in a mechanical or electronic, analog or digital format. What is anticipated as being new to the art, however, would be the incorporation of a means to acquire and display a "power rating", thereby providing the user with instantaneous or aggregated reading of the power generated by the user while performing on the present invention.

Figure 3:
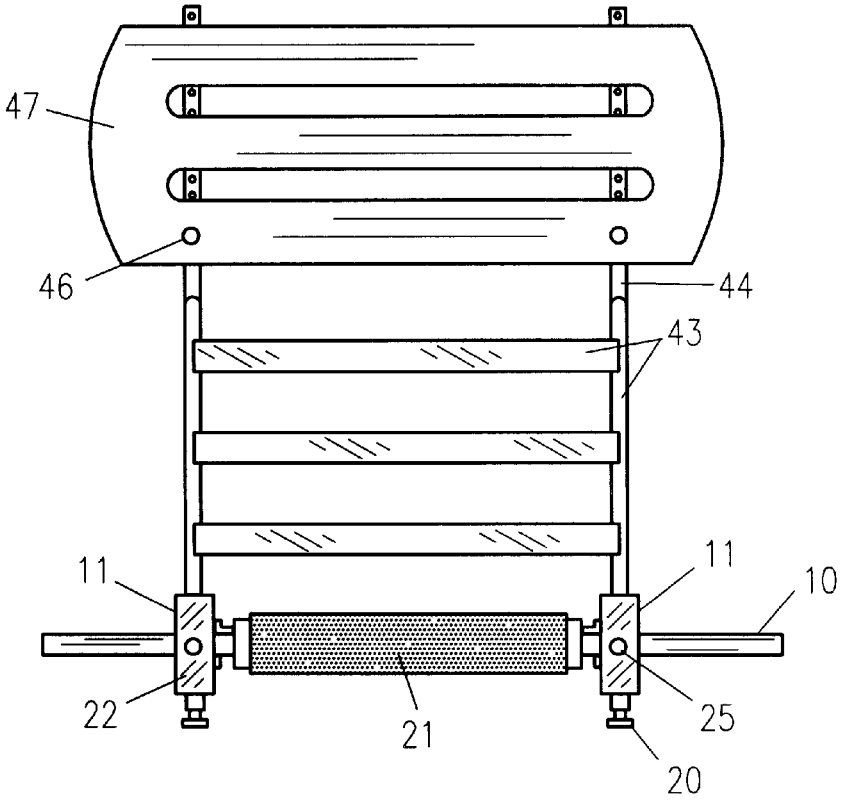
FIG. 3 is a rear view of a power mill, according to the preferred embodiment of the present invention.
Figure 4:
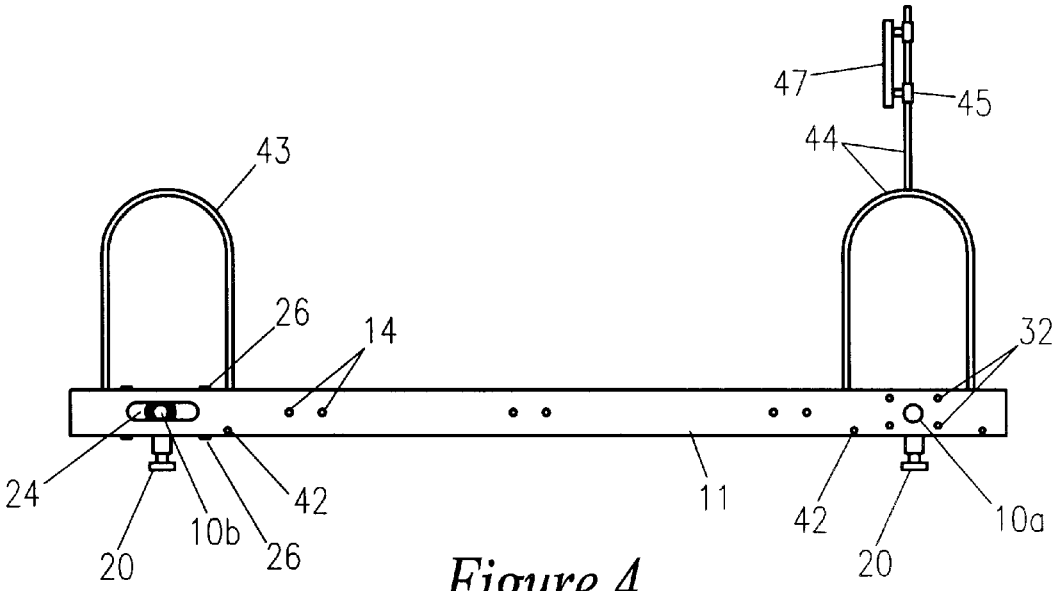
FIG. 4 is a side view of a power mill, according to the preferred embodiment of the present invention.

Referring now to FIG. 3 and FIG. 4, a front view and side view of a Power Mill 5 is shown, according to the preferred embodiment of the present invention. Push Board 46 provides a soft, durable, and safe surface for a full range of varied hand placements and grips. It also provides a broad surface suitable for the user to push backwards against using their back or hips whilst using their legs to cause Tread Belt 21 to rotate about Spindles 10*a* and 10*b*, simulating the effort required in pushing a large object such as a car or small truck. Once the belt is rotating, conventional Olympic weight lifting plates placed on the protruding ends of Spindles 10*a* and 10*b* act as a flywheel giving the belt a more constant speed once the user has gotten the belt in motion. Push board 21 is constructed of a lightweight frame and backing board coated with a high density foam that is sealed with a tough rubberized material. Push Board 47 is mounted on Push Rail 44 via Quick Release Pins 46 protruding through a pair of holes drilled in said Push Board 47, a mounting bracket 45 attached thereto, and holes in the Push Rail 44 tubing. In an alternate preferred embodiment, a simple clamping means may be utilized to mount said Push Board 47 on Push Rail 44. Push Rail 44 is made from conventional steel tubing bent and formed to desired shape. A plurality of holes located in the vertical riser portion of said Push Rail 44 allow the user to adjust the height of said Push Board 47. Push Rail 44 is mounted to Frame Rails 11R and 11L via Mounting Brackets 50 welded to said Frame Rails 11R and 11L for receiving the bottom tubing ends of Push Rail 44 and secured thereto via Push/Pull Rail Quick Release Mounting Pins 41. Pull Rail 43 is located at the rear end of Push Mill 5 attached to Frame Rails 11R and 11L via Push/Pull Rail Quick Release Mounting Pins 41 and Mounting Bracket 50. Pull Rail 43 provides heavy duty anchoring for pulling a cable hook-up for optional gym accessories such as a straight triceps bar, lat-pull down bar, triangle bars, cable cross-over handles, ropes, body harness, etc. Pull Rail 43 is two arched frame supports joined by three cross members. Each cross member has a heavy duty pulling eyelet for securing the cable hook-up. Each cross member provides a different anchoring level for the pulling cable option allowing for varying pull angle and user body heights. In this manner, the simulating of pulling a heavy object can be accomplished.

Figure 5:
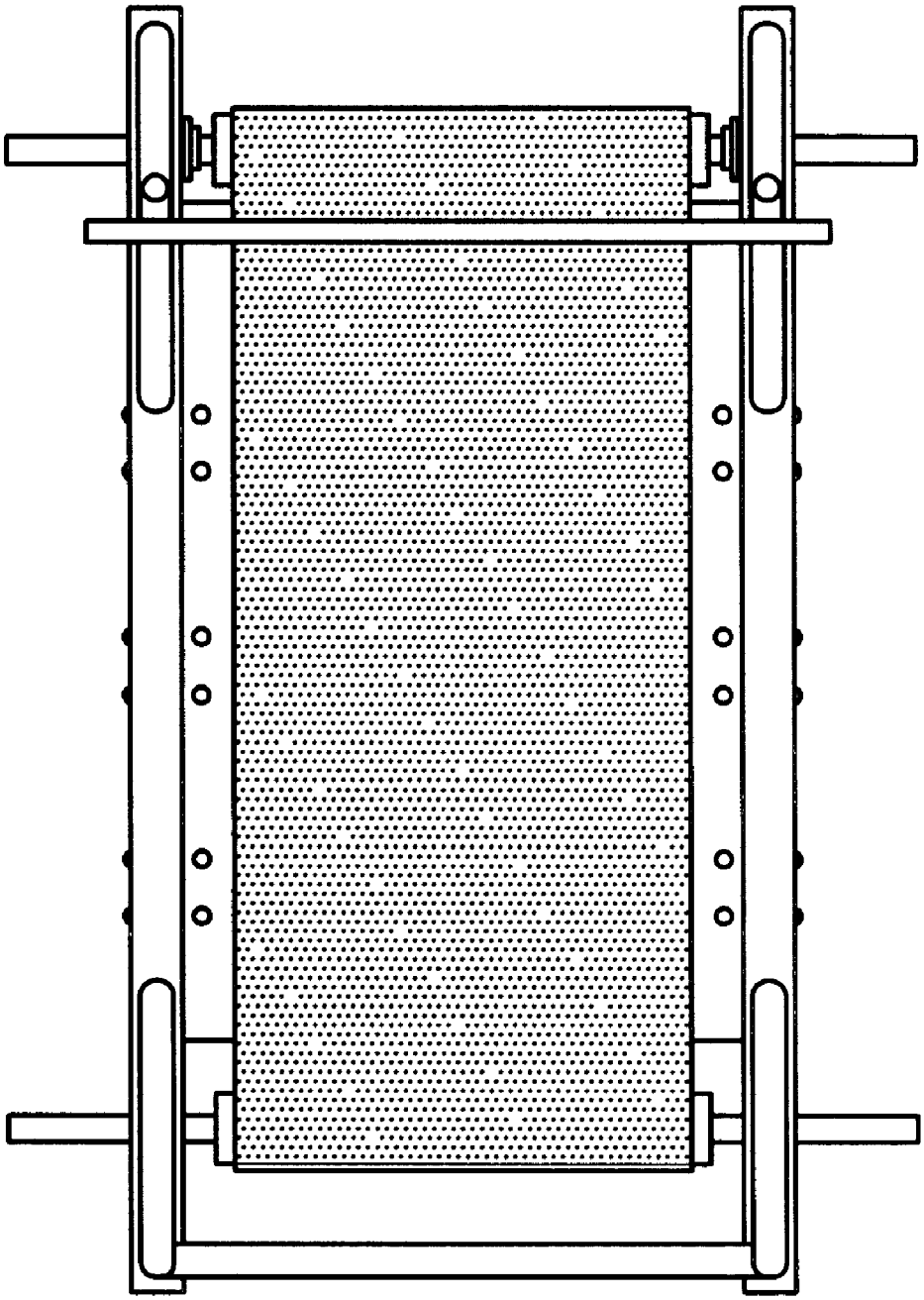
FIG. 5 is a front view of a power mill, according to the preferred embodiment of the present invention.

Referring now to FIG. 5 and 6, a rear view and a top view of a Power Mill 5 is shown, according to the preferred embodiment of the present invention. The detail of the plurality of apertures for adjusting the Push Board 47 to various heights according to user desire is shown. Also shown is the outer surfaces of Spindle 10*a* protruding outboard of Frame Rail 11R and 11L for receiving conventional Olympic weight lifting plates or other similarly fixed mass.

The foregoing description is included to illustrate the operation of the preferred embodiment and is not meant to limit the scope of the invention. The scope of the invention is to be limited only by the following claims.

What is claimed is:

1. A variable resistance treadmill for simultaneously simulating a rolling and sliding resistance and a moving inertia, said treadmill comprising:

a treadmill assembly having a continuous loop tread, a frame, and two spindles opposed spindles in communication with and driven rotationally by said loop tread;

means to create and control friction applied to said spindles when rotating;

means to create inertial resistance to said spindles when rotating;

a push rail vertically affixed to a first end of said frame; and a pull rail vertically affixed to a second end of said frame opposite to said first end.

2. The treadmill of claim 1, wherein said spindles are capable of receiving and support a flywheel mass.

3. The treadmill of claim 2, wherein said flywheel mass comprises at least one conventional Olympic weight plate or other similarly fixed mass.

4. The treadmill of claim 1, wherein said means to create and control friction applied to said spindles when rotating comprises a Friction Resistance System Block having Friction Resistance System Brake Shoes that are urged to physical impingement with an outer surface of at least one said spindle.

5. The treadmill of claim 4, further comprising means for providing an urging force to the Friction Resistance System Blocks.

6. The treadmill of claim 5, wherein said means for providing an urging force is selected from the group comprising direct physical linkage, pneumatic communication, electronic communication to electronic solenoids, and hydraulic communication.

7. The treadmill of claim 5, further comprising a data acquisition means for providing information feedback to the user.

8. The treadmill of claim 7, wherein said data acquisition means further incorporates of a means to acquire and display a "power rating", thereby providing the user with instantaneous or aggregated reading of the power generated by the user while performing on the present invention.

9. The treadmill of claim 1, wherein said continuous tread belt is of continuous loop construction being made from high strength flexible rubber-fiber matting and includes:

a textured outer surface for providing a surface for mating with the feet of the user, and an inner surface for non-slip mating with spindles; and said belt being rotatably suspended there between said spindles.

10. The treadmill of claim 1, wherein said treadmill assembly includes frame rails constructed from conventional steel rectangular shaped channel each having a front end, a rear end, and an elongated longitudinal axis, each said frame rails cut to desired length from conventional length steel rectangular shaped channel.

11. The treadmill of claim 10, wherein said treadmill assembly further includes floor cross beams that interconnect said frame rails near each end of said frame rail, and one floor cross beam that interconnects said frame rail near the center, said floor cross beams also cut to desired length from conventional length rectangular channel and each end of said floor cross beam receiving one floor cross beam end plate permanently welded thereto.

12. The treadmill of claim 1, wherein said treadmill assembly is supported and raised off of the floor by a plurality of four frame legs located one each on each end of said frame rails.

13. The treadmill of claim 4, wherein said spindles are cylindrical in shape having two ends, dual outer surfaces located adjacent to each of said ends, a single inner surface located between said dual outer surfaces, and an elongated longitudinal axis, said spindles being formed of high strength steel machined and polished on said dual outer surfaces to a diameter for receiving conventional Olympic size weight training plates and on said single inner surface to a diameter for receiving and providing a non-slip mating surface for said inner surface of said tread belt.

14. The treadmill of claim 13, wherein one said spindle is rotatably supported on said dual outer surfaces by take-up bearings slidably fixed inside of the hollow inner cavity of said frame rails; and, the other said spindle is rotatably supported on said dual outer surfaces by spindle bearings permanently affixed on the front ends and inboard outer surface of frame rails by friction resistance system and shaft bearing assembly bolts such that the outer surfaces of spindle protrude through the center aperture of said shaft bearing and continue a length past the outboard edges of said frame rails through a circular aperture specially formed in the front end of frame rails.

15. The treadmill of claim 14, further comprising means whereby the tension in said tread belt can be adjusted.

16. The treadmill of claim 1, further comprising a push board affixed to said push rail for providing a soft, durable, and safe surface for a full range of varied hand placements and grips, and also providing a broad surface suitable for the user to push backwards against using their back or hips whilst using their legs to cause tread Belt to rotate about said spindles, whereby simulating the effort required in pushing a large, heavy object.

* * * * *